US006603102B2

(12) United States Patent
Brown et al.

(10) Patent No.: US 6,603,102 B2
(45) Date of Patent: Aug. 5, 2003

(54) PRESSURE MONITORING ARRANGEMENT FOR HEATING SYSTEM OF A CONVECTION COOKING APPLIANCE

(75) Inventors: John Scott Brown, Charleston, TN (US); Richard O. Cavener, Ooltewah, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/005,841

(22) Filed: Dec. 7, 2001

(65) Prior Publication Data

US 2002/0040902 A1 Apr. 11, 2002

Related U.S. Application Data

(63) Continuation-in-part of application No. 09/902,655, filed on Jul. 12, 2001, which is a continuation of application No. 09/650,417, filed on Aug. 29, 2000, now Pat. No. 6,291,808.

(60) Provisional application No. 60/153,224, filed on Sep. 13, 1999.

(51) Int. Cl.[7] ..... H05B 6/68

(52) U.S. Cl. ..... 219/681; 219/400; 219/685; 219/704; 219/705; 126/21 A; 99/451

(58) Field of Search ..... 219/681, 682, 219/683, 684, 685, 400, 401, 757, 704, 707, 705; 126/21 A; 99/325, 451

(56) References Cited

U.S. PATENT DOCUMENTS

| | | | | |
|---|---|---|---|---|
| 3,521,032 A | | 7/1970 | Heuss | |
| 3,889,009 A | * | 6/1975 | Lipoma | 219/682 |
| 4,154,861 A | | 5/1979 | Smith | |
| 4,173,215 A | * | 11/1979 | Bureau et al. | 219/401 |
| 4,327,279 A | | 4/1982 | Guibert | |
| 4,397,875 A | | 8/1983 | Gilliom | |
| 4,431,889 A | | 2/1984 | Saponara et al. | |
| 4,455,478 A | | 6/1984 | Guibert | |
| 4,480,164 A | | 10/1984 | Dills | |
| 4,503,760 A | | 3/1985 | Pryputsch et al. | |
| 4,827,106 A | | 5/1989 | Margraf | |
| 4,827,903 A | | 5/1989 | Kim | |
| 4,940,869 A | | 7/1990 | Scholtes et al. | |
| 5,066,851 A | | 11/1991 | Darvin | |
| 5,089,679 A | | 2/1992 | Eke | |
| 5,107,126 A | | 4/1992 | Yano | |
| 5,257,574 A | | 11/1993 | Hiromichi | |
| 5,290,575 A | | 3/1994 | Torikata | |
| 5,339,726 A | | 8/1994 | Poulson | |
| 5,615,603 A | | 4/1997 | Polin | |
| 5,662,029 A | | 9/1997 | Ubert et al. | |
| 5,676,044 A | | 10/1997 | Lara, Jr. | |
| 5,676,051 A | * | 10/1997 | Sinemus | 99/476 |
| 5,717,192 A | | 2/1998 | Dobie et al. | |
| 5,767,493 A | | 6/1998 | Lautenschlager | |
| 5,927,265 A | | 7/1999 | McKee et al. | |
| 6,060,701 A | | 5/2000 | McKee et al. | |
| 6,291,808 B1 | * | 9/2001 | Brown | 219/681 |

FOREIGN PATENT DOCUMENTS

| | | | |
|---|---|---|---|
| DE | 39 31 482 | 4/1991 | |
| JP | 3-144219 | 6/1991 | |
| JP | 3-246881 | * 11/1991 | 219/685 |

* cited by examiner

*Primary Examiner*—Philip H. Leung
(74) *Attorney, Agent, or Firm*—Diederiks & Whitelaw, PLC

(57) ABSTRACT

A convection cooking appliance includes an oven cavity surrounded by an air channel assembly. The appliance includes heating units and a microwave generator arranged in the air channel assembly. A blower assembly is provided to generate a recirculating flow of air through the air channel assembly and the oven cavity. A controller, responsive to operator inputs, as well as signals from both temperature and pressure sensors located in the air channel assembly, regulates the activation/deactivation state of each of the components. One of the heating units in the air channel assembly is preferably constituted by an open coil heating element which is de-activated when the pressure is sensed to be below a specified threshold.

14 Claims, 4 Drawing Sheets

PRESSURE MONITORING ARRANGEMENT FOR HEATING SYSTEM OF A CONVECTION COOKING APPLIANCE

The present application constitutes a continuation-in-part of U.S. patent application Ser. No. 09/902,655 filed Jul. 12, 2001, pending, which is a continuation of U.S. patent application Ser. No. 09/650,417 filed Aug. 29, 2000, now U.S. Pat. No. 6,291,808, which claimed the benefit of U.S. Provisional Patent Application No. 60/153,224 filed Sep. 13, 1999.

BACKGROUND OF THE INVENTION

1. Field of the Invention

The present invention pertains to the art of cooking appliances and, more particularly, to a convection oven incorporating a pressure sensor in a recirculating air flow path for use in controlling at least one heating element of the cooking appliance.

2. Discussion of the Prior Art

It is known in the art of cooking appliances to utilize multiple heating elements within a single oven cavity for use in connection with baking, broiling and/or cleaning modes of operation. It has also been proposed in the art to incorporate a fan within the cooking appliance to enhance the flow of heated air through the oven cavity in order to provide for a more uniform temperature distribution and reduce required cooking times within the oven.

Regardless of these known prior art arrangements, there exists a need for further enhancements in the control of the heated air flow for a convection oven. More specifically, since the heating element(s) is actually being cooled by the convection air flow, it is possible to operate the heating element(s) at a higher temperature, which can further reduce cooking times. However, if a higher operating temperature is established and the air flow was decreased, the result could be damage to the heating element(s). When electric heating elements are employed, a high resistance short to the chassis of the cooking appliance can also be created.

Based on the above, there exists a need in the art of cooking appliances for a convection oven arrangement with enhanced control features which enables one or more electric heating elements to operate at relatively high temperatures when a flow of air is directed across the heating element(s), while automatically reducing an operating temperature of the heating element(s) when the flow is disrupted.

SUMMARY OF THE INVENTION

In accordance with the invention, a convection cooking appliance is provided with at least one electric heating unit disposed outside an oven cavity of the cooking appliance. More particularly, the heating unit is disposed in a duct section of an air channel assembly which extends about and is in fluid communication with the oven cavity. A flow of air is directed through the channel assembly by a blower. In the most preferred form of the invention, a pressure sensor is employed to sense air pressure within the air channel assembly. The pressure sensor is linked to a controller for the heating unit in order to reduce or interrupt a current supply to the heating unit when the air pressure drops below a threshold value.

In the most preferred embodiment of the invention, the heating unit is centered in the air flow stream and arranged continuous from side-to-side. The heating unit preferably defines a single coil extending in various rows, with each of the coil rows being arranged substantially perpendicular to the flow of air. With this configuration, the heating unit tends to interrupt any developing patterns of air flow other than a linear flow in a desired direction. Furthermore, the pressure sensor is preferably positioned so as to sense the pressure in the air channel assembly directly adjacent the heating unit.

Additional objects, features and advantages of the present invention will become readily apparent from the following detailed description of a preferred embodiment thereof, when taken in conjunction with the drawings wherein like reference numerals refer to corresponding parts in the several views.

DETAILED DESCRIPTION OF THE PREFERRED EMBODIMENT

Figure 1:
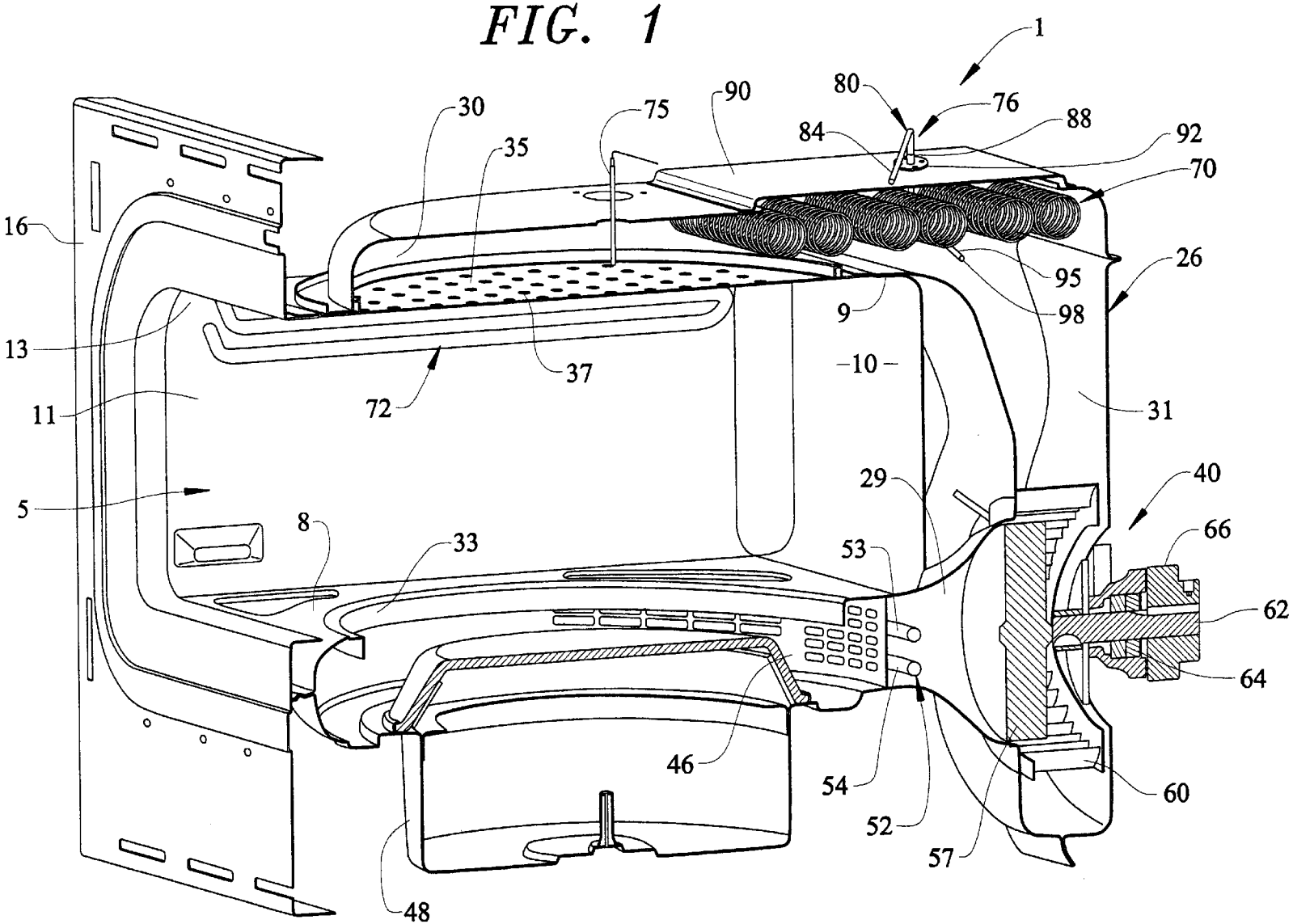
FIG. 1 is a perspective, partial sectional view of a convection cooking appliance constructed in accordance with the present invention.
Figure 2:
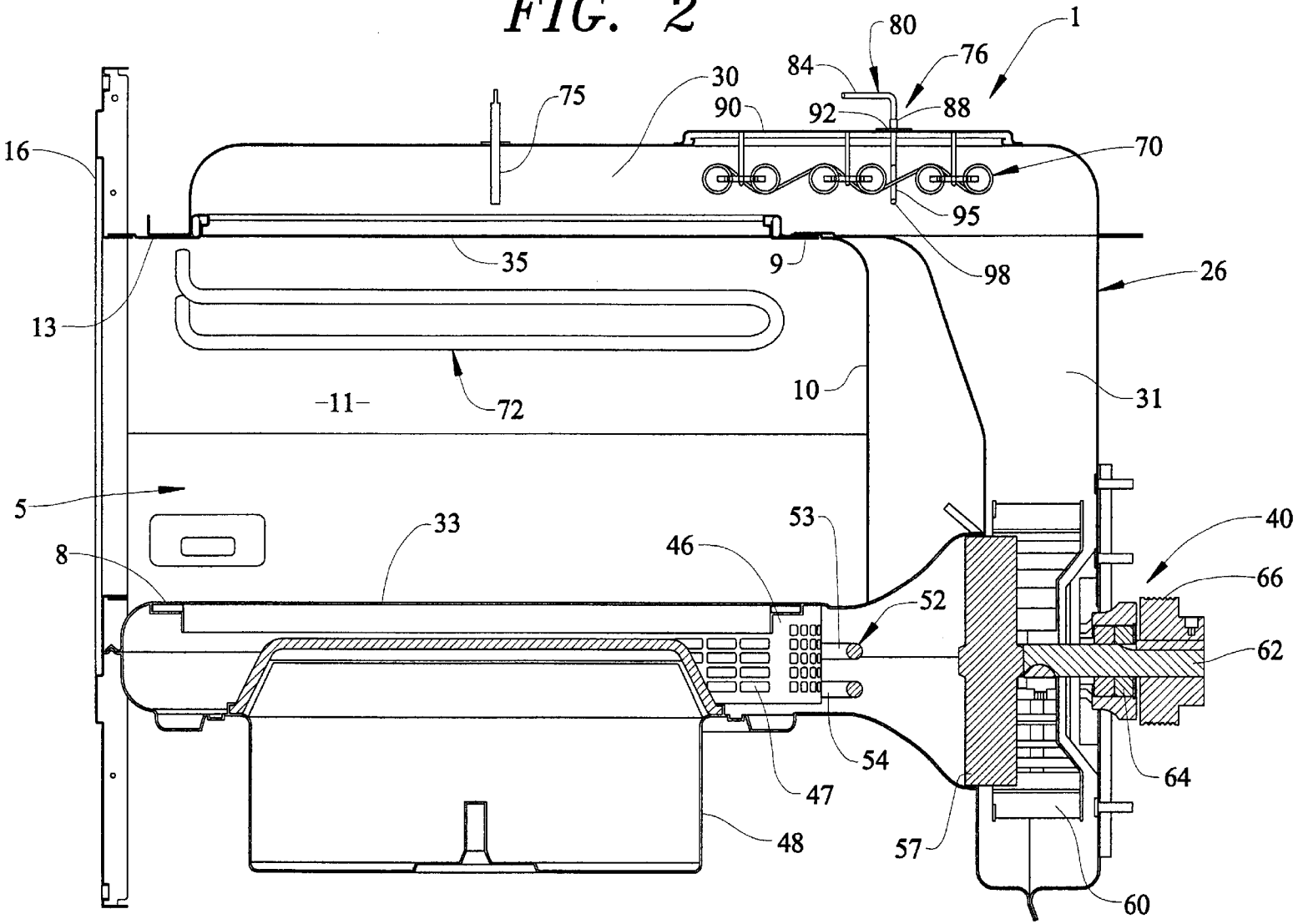
FIG. 2 is a cross-sectional side view of the cooking appliance of FIG. 1.
Figure 3:
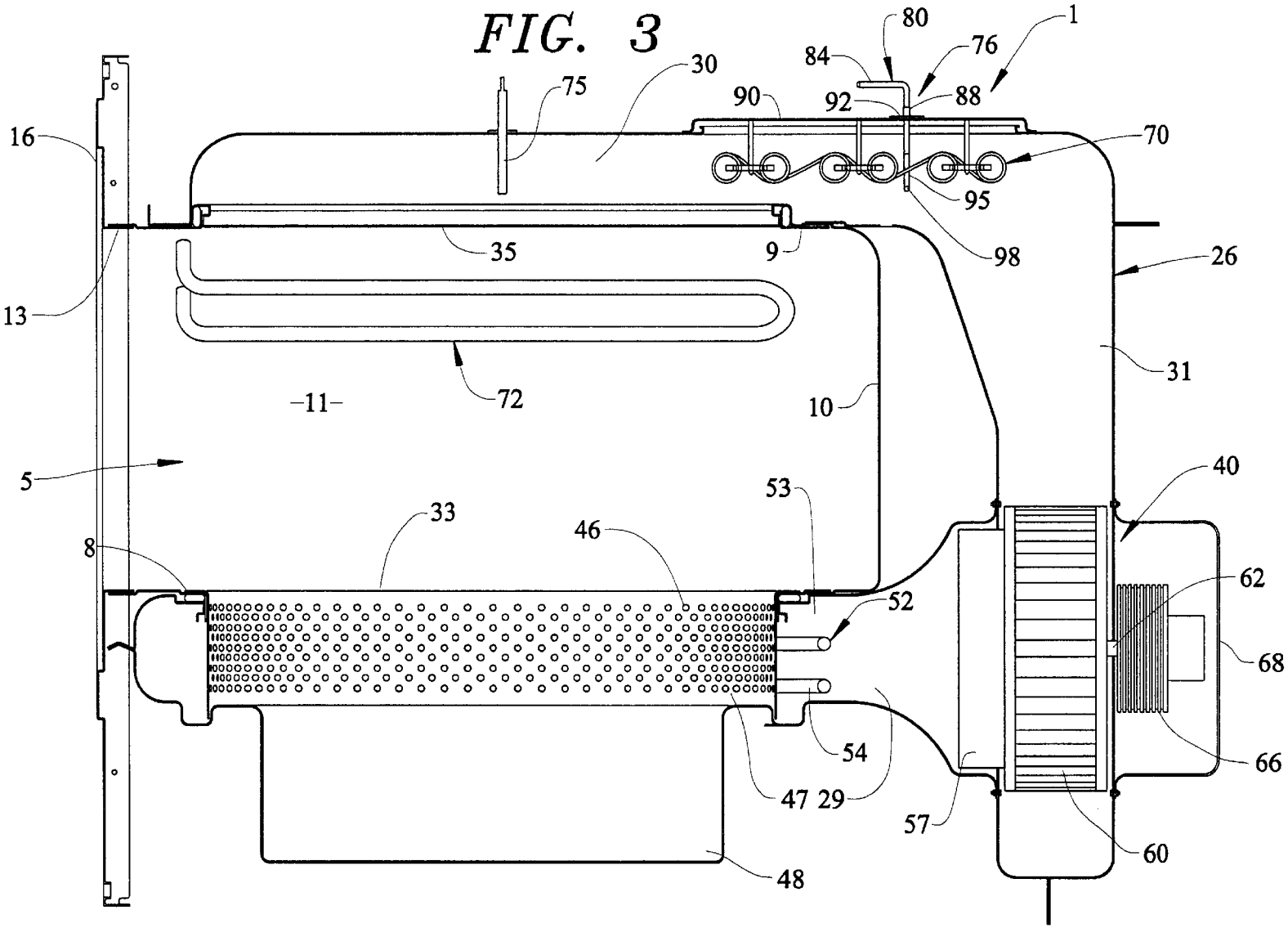
FIG. 3 is a schematic side view, similar to that of FIG. 2, of the cooking appliance.

With initial reference to FIGS. 1–3, a cooking appliance 1 is schematically shown in the form of a wall oven. Appliance 1 includes an oven cavity 5 generally defined by a bottom wall 8, a top wall 9, a rear wall 10 and a pair of side walls, one of which is indicated at 11. Oven cavity 5 also has associated therewith an access opening 13 for food items to be placed into or withdrawn from cavity 5. About access opening 13 is provided a frontal plate 16. In a manner known in the art, frontal plate 16 is adapted to be mounted against a substantially vertical wall such as in the kitchen of a residential home, and would have a door (not shown) pivotally attached thereto for selectively sealing off access opening 13.

Extending generally along top, bottom and rear portions of cavity 5 is an air channel assembly 26 defined by ducting that leads into and out of cavity 5. More specifically, air channel assembly 26 includes a lower air return section 29, an upper air delivery section 30 and a rear air transfer section 31. Lower air return section 29 is open into cavity 5 through a substantially central return air outlet 33 formed in bottom 8. In the most preferred form of the invention, return air outlet 33 is constituted by a generally circular insert provided with various spaced holes (not shown). In a similar manner, upper air delivery section 30 includes a discharge or delivery inlet 35 formed in top wall 9. Although only partially shown in FIG. 1, inlet 35 is also preferably constituted by a generally circular-shaped insert which is attached to the remainder of upper air delivery section 30 and which is provided with a plurality of holes 37.

As will become more fully evident below, the particular construction of cooking appliance 1 can significantly vary in accordance with the present invention. More specifically, it is only important in accordance with the present invention that cooking appliance 1 include an air channel assembly, such as that discussed above with reference to assembly 26, as well as a blower assembly, such as that generally indicated at 40, for use in generating a circulating flow of air through oven cavity 5. Although not considered a part of the present invention, a preferred construction for oven cavity 5 and air channel assembly 26 can be found in pending U.S. patent application Ser. No. 09/649,957 entitled "OVEN CAVITY CONSTRUCTION" filed Sep. 13, 1999 which is hereby incorporated by reference.

In the preferred embodiment shown, cooking appliance 1 constitutes an electric appliance and, more specifically, a combination convection, microwave and radiant cooking device. As shown in this figure, cooking appliance 1 is provided with an annular filter basket 46, having a multitude of circumferentially spaced holes 47, which is positioned within lower air return section 29 and through which the air flowing from cavity 5 through return air outlet 33 is directed. Arranged below filter basket 46 is a microwave generator unit 48 incorporating a magnetron and mode stirrer (both not specifically shown).

Encircling at least a portion of filter basket 46 is a first electric heating element 52. Heating unit 52 is shown as constituted by a sheathed electric resistance heating element having upper and lower interconnected legs 53 and 54. First electric heating unit 52 is preferably provided to heat return air flowing from oven cavity 5, through outlet 33 and filter basket 56 prior to the air reaching a catalyst indicated at 57. In a manner known in the art, catalyst 57 functions to eliminate smoke and the like from the air stream. As shown, catalyst 57 extends partially within a rotatable blower element 60 which forms part of blower assembly 40. Although blower element 60 can take various forms while performing the desired air flow generating function, blower element 60 preferably constitutes a centrifugal unit arranged at the juncture of lower air return section 29 and rear air transfer section 31. In general, blower element 60 is secured to a shaft member 62 that is rotatably mounted through a bearing assembly 64. Shaft member 62 also has attached thereto, for non-relative rotation, a sheave 66 which is adapted to receive a belt (not shown) for use in rotating blower element 60 through shaft member 62 in combination with an electric motor (also not shown). As illustrated, sheave 66 is preferably arranged within a housing extension 68 which projects from rear air transfer section 31.

Preferably mounted in upper air delivery section 30 adjacent rear transfer section 31 is a second electric heating element arrangement 70 that is preferably constituted by a bank of open heating coils. Most preferably, second heating unit 70 is defined by a single open electric coil arranged in multiple rows, with each row running back and forth across essentially the entire width of upper air delivery section 30 so as to be substantially perpendicular to the direction of flow through upper air delivery section 30. In any event, second heating unit 70 functions to further heat the air flowing through channel assembly 26 prior to the air reaching discharge inlet 35 as will be more fully discussed below.

Also shown in this figure is a third electric heating unit 72 which, in a manner similar to first electric heating unit 52, is preferably constituted by a sheathed, resistance-type heating element. Third electric heating unit 72 preferably extends adjacent top wall 9 and constitutes an additional heat source for cavity 5 of cooking appliance 1. The particular manner in which first, second and third electric heating units 52, 70 and 72 are utilized during operation of cooking appliance 1 for a cleaning mode of operation is detailed in U.S. patent application Ser. No. 09/650,416 filed Sep. 13, 1999 entitled "SELF-CLEANING SYSTEM FOR A COOKING APPLIANCE" which is hereby incorporated by reference.

Figure 4:
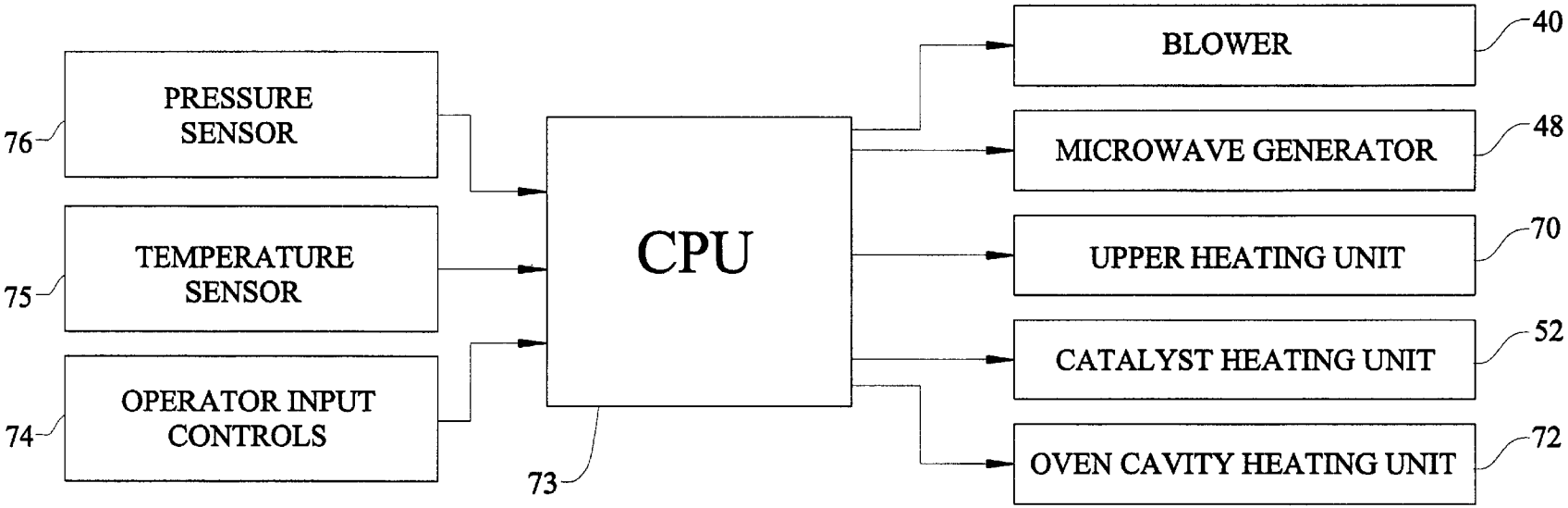
FIG. 4 is a block diagram illustrating a control arrangement used in the convection cooking appliance of the invention.

As represented in FIG. 4, each of blower assembly 40, microwave generator 48 and first, second and third electric heating units 52, 70 and 72 are linked to an appliance controller or CPU 73 and regulated based on established operator settings input at 74, as well as signals received from a temperature sensor 75 and a pressure sensor 76. The present invention is particularly directed to the manner in which cooking appliance 1 can be effectively operated, while assuring that one or more of heating units 52, 70 and 72 do not get overloaded due to a lack of air flow within air channel assembly 26.

First of all, a user of cooking appliance 1 can select, through operator input controls 74, a convection cooking mode wherein heating element 52 is initially activated, along with blower assembly 40 and heating unit 70, to direct a flow of recirculating air through oven cavity 5. With this arrangement, heated air will be caused to flow within air channel assembly 26 and through holes 37 in order to impinge on food items to be cooked within oven cavity 5. During operation, blower assembly 40 can produce a certain degree of turbulence which is considered detrimental to the uniform and consistent flow of air through channel assembly 26. However, as indicated above, heating unit 70 is preferably constituted by various rows of open coils, with six rows of coils being shown in the preferred embodiment depicted in the drawings. Since the coils are open and arranged perpendicular to the flow of air, any turbulence developed by the operation of blower assembly 40 is transformed into a linear or laminar flow which enhances a smooth and continuous flow through oven cavity 5 for uniform heating.

During a convection cooking mode of operation, heating unit 70 can be cycled on and off by controller 73 in dependence on the temperature of the air as signaled by sensor 75, and the operation of heating unit 70 can be disrupted based on a pressure measured by pressure sensor 76 in air channel assembly 26 as will be discussed more fully below. Within the spirit of the invention, heating unit 70 can also be variably controlled, such as by establishing low, medium or high wattage settings. Although not shown, heating unit 70 is preferably, electrically linked to controller 73 through the use of a triac. Regardless of the particular operating status of heating unit 70, blower assembly 40 and heating unit 52 are operated continuously throughout the convection cooking mode in accordance with the most preferred embodiment of the invention. The user of cooking appliance 1 can also select a microwave cooking mode wherein controller 73 activates generator 48. Again, heating unit 52 is preferably, continuously operated whenever cooking appliance 1 is operational. Furthermore, in a cleaning mode, each of heating units 52, 70 and 72 are controlled for effective preheating and high temperature operation as referenced above.

As clearly shown in the drawings, pressure sensor 76 is preferably mounted directly adjacent heating unit 70 and includes a sensing tube 80 having a first end portion 84, which is arranged outside of air channel assembly 26, an intermediate portion 88, which is secured to and extends through a cover 90 for heating unit 70 by means of a mounting plate 92, and a second end portion 95 which preferably angles down and towards a central zone of air channel assembly 26. First end portion connected to a switch (not shown) which, in turn, is linked to controller 73. On the other hand, second end portion 95 has a open end 98 exposed to within air channel assembly 26.

With this arrangement, pressure sensor 76 is used to sense the air pressure within air channel assembly 26. As shown, pressure sensor 76 is located downstream of blower assembly 40 and, most preferably, directly adjacent heating unit 70. In accordance with the most preferred form of the invention, when pressure sensor 76 senses that the air pressure in this portion of air channel assembly 26 falls below a specified threshold and signals the same to CPU 73, CPU 73 functions to interrupt the flow of current to upper heating unit 70. Preferably, heating unit 70 will not be energized when the air pressure is below the specified threshold. In this manner, heating unit 70 will be protected from damage and any potential high resistance short will be avoided when certain undesirable circumstances exists. Particularly, heating unit 70 will be interrupted if blower assembly 40 stops running, whether through a fault or controlled operation, the drive belt to blower 40 fails, or the bearings associated with blower 40 seize up. Therefore, the incorporation of pressure sensor 76 functions as a redundant safety circuit for the overall cooking appliance 1.

Although described with respect to a preferred embodiment of the invention, it should be recognized that various changes and/or modifications can be made to the invention without departing from the spirit thereof. For example, although the invention has been described as having pressure sensor 76 linked to heating unit 70 through CPU 73, a pressure sensor 76 could be linked through a suitable switch to directly interrupt power to heating unit 70 when the pressure threshold requirement is met. In addition, it should be realized that signals from pressure sensor 76 can also be used in controlling the operation of heating unit 52 and/or 72 as well. Furthermore, it is contemplated that pressure sensor 76 can be relocated, preferably still within air channel assembly 26, in accordance with the invention. In any event, the invention is only intended to be limited by the scope of the following claims.

We claim:

1. In a cooking appliance including an oven cavity adapted to be used in convection cooking of food products, a heating system comprising:

an air channel assembly extending about at least a portion of and being in fluid communication with the oven cavity;

a blower element for developing a flow of air within the air channel assembly for delivery to the oven cavity;

a heating unit positioned in the air channel assembly for heating the flow of air prior to entry into the oven cavity; and a pressure sensor located downstream of the blower element and directly adjacent the heating unit in the air channel assembly, wherein operation of the heating unit is controlled based on a pressure sensed by the pressure sensor.

2. The heating system according to claim 1, wherein the pressure sensor includes a tube projecting into the air channel assembly.

3. The heating system according to claim 1, further comprising: a controller for regulating the operation of the heating unit, said pressure sensor being linked to the controller for signaling the pressure to the controller.

4. The heating system according to claim 3, wherein the heating unit comprises a bank of heating coils.

5. The heating system according to claim 4, wherein the bank of heating coils comprises a plurality of electrically interconnected rows, sequentially arranged between the blower element and the oven cavity, with each of the plurality of rows extends transversely across the air channel assembly so as to be substantially perpendicular to a direction of travel of the flow of air.

6. The heating system according to claim 1, further comprising: a microwave generator for selectively generating a flow of microwaves into the oven cavity.

7. In a cooking appliance including an oven cavity adapted to be used in convection cooking of food products, a heating system comprising:

an air channel assembly extending about at least a portion of and being in fluid communication with the oven cavity;

a blower element for developing a flow of air within the air channel assembly for delivery to the oven cavity;

a heating unit positioned in the air channel assembly for heating the flow of air prior to entry into the oven cavity;

a pressure sensor positioned in the air channel assembly; and a controller for regulating the operation of the heating unit, said pressure sensor being linked to the controller for signaling the pressure to the controller, wherein the controller interrupts power to the heating unit when the pressure, as sensed by the pressure sensor, is below a threshold value.

8. The heating system according to claim 7, further comprising: a temperature sensor for sensing an operating temperature of the cooking appliance, wherein the temperature sensor is arranged in the air channel assembly and linked to the controller.

9. In a cooking appliance including an oven cavity adapted to be used in convection cooking of food products, a method of controlling the beating of the oven cavity comprising:

directing a flow of air within an air channel assembly extending about at least a portion of and being in fluid communication with the oven cavity:

activating a heating unit positioned in the air channel assembly for heating the flow of air prior to entry into the oven cavity;

sensing an air pressure in the air channel assembly directly adjacent the heating unit; and controlling the heating unit based on the sensed air pressure.

10. The method of claim 9, further comprising: de-activating the heating unit when the sensed pressure is below a threshold value.

11. The method of claim 10, further comprising:

signaling the sensed pressure to a controller of the cooking appliance; and de-activating the heating unit through the controller.

12. The method of claim 11, further comprising:

sensing a temperature in the air channel assembly;

signaling the sensed temperature to the controller; and regulating the heating unit, through the controller, based on the sensed temperature.

13. The method of claim 9, further comprising: generating a flow of microwaves into the oven cavity.

14. The method of claim 9, further comprising: converting the air flow within the air channel assembly from a turbulent flow to a laminar flow prior to the oven cavity.

* * * * *